US006158083A

United States Patent [19]

Holsten

[11] Patent Number: 6,158,083

[45] Date of Patent: Dec. 12, 2000

[54] WET/DRY VACUUM WITH REDUCED OPERATING NOISE

[75] Inventor: Stuart V. Holsten, O'Fallon, Mo.

[73] Assignee: Emerson Electric, Co., St. Louis, Mo.

[21] Appl. No.: 09/386,749

[22] Filed: Aug. 31, 1999

Related U.S. Application Data

[60] Provisional application No. 60/098,434, Aug. 31, 1998.

[51] Int. Cl.[7] ..... A47L 9/00

[52] U.S. Cl. ..... 15/326; 15/327.6; 15/412; 417/312

[58] Field of Search ..... 15/326, 327.2, 15/412; 417/312

[56] References Cited

U.S. PATENT DOCUMENTS

| | | | |
|---|---|---|---|
| 2,276,844 | 3/1942 | Holm-Hansen | 15/327.6 |
| 4,120,616 | 10/1978 | Dwyer et al. | 15/326 X |
| 4,330,899 | 5/1982 | Miller et al. | 15/326 |
| 4,735,555 | 4/1988 | Erickson | 417/312 X |
| 5,365,633 | 11/1994 | Sunagawa et al. | 15/326 |
| 5,388,301 | 2/1995 | Bosyj et al. | 15/327.6 X |
| 5,567,127 | 10/1996 | Wentz | 417/312 |
| 6,055,700 | 5/2000 | Holsten et al. | 15/327.6 X |

*Primary Examiner*—Chris K. Moore
*Attorney, Agent, or Firm*—Howrey Simon Arnold & White, LLP

[57] ABSTRACT

A wet/dry vacuum appliance having enhanced air-handling performance and reduced operating noise is described. In one embodiment, the collector scroll in a wet/dry vacuum is configured so as to isolate the vacuum's impeller from geometries prone to increase operating noise at particular frequencies. Further, the overall geometry and configuration of the air flow path through the power head of the vacuum is such that air-handling performance is enhanced even as noise levels are reduced. In the disclosed embodiment, the wet/dry vacuum is of the detachable power head type, although non-detachable power head implementations are contemplated.

14 Claims, 15 Drawing Sheets

WET/DRY VACUUM WITH REDUCED OPERATING NOISE

RELATED APPLICATION

This application claims the priority of prior provisional U.S. patent application Ser. No. 60/098,434 filed Aug. 31, 1998, the content of which being hereby incorporated by reference herein in its entirety.

FIELD OF THE INVENTION

This invention relates generally to the field of vacuum cleaner appliances, and more particularly relates to a wet/dry type of vacuum cleaner.

BACKGROUND OF THE INVENTION

Vacuum cleaner appliances capable of picking up both wet and dry material, commonly referred to as wet/dry vacuums or wet/dry vacs, are well-known. Wet/dry vacs are often used in workshops and other environments where both wet and dry debris can accumulate.

Wet/dry vacs conventionally consist of a collection tank or canister, often mounted on wheels or casters, and a cover or lid upon which a motor and impeller assembly is mounted. The motor and impeller assembly creates a suction within the canister, such that debris and liquid are drawn in to the canister through an air inlet to which a flexible hose can be attached. A filter within the canister prevents incoming debris from escaping from the canister while allowing filtered air to be forcibly expelled through an air outlet. One example of a such a wet/dry vac is shown in U.S. Pat. No. 4,797,072.

Prior art examples of wet/dry vacuums include: U.S. Pat. No. 5,548,868 to Berfield et al., entitled "Pilot and Detent Apparatus for a Vacuum Device;" U.S. Pat. No. 5,535,500 to Stephens et al., entitled "Method for Manufacturing a Bucket for a Wet/Dry Vacuum;" U.S. Pat. No. 5,598,605 to Tomasiak, entitled "Wet/Dry Utility Vacuum with a Wheel Mount;" U.S. Pat. No. 5,555,600 to Corson, entitled "Non-Tipping Wet/Dry Vacuum;" U.S. Pat. No. 5,606,769 to Tomasiak, entitled "Wet/Dry Utility Vacuum Cleaner with Detachable Blower;" U.S. Pat. No. 5,608,945 to Crouser, et al., entitled "Wet/Dry Utility Vacuum Cleaner;" and U.S. Pat. No. 5,611,107 to Tomasiak et al., entitled "Latching Mechanism for Wet/Dry Utility Vacuum Cleaner with Detachable Blower."

A typical wet/dry vac motor and blower assembly comprises a motor having a closed-face, multiple-blade blower wheel or impeller disposed on a drive shaft thereof. The motor and blower assembly is typically disposed in a collection canister lid assembly, with the rotating blower wheel disposed within a blower chamber, sometimes referred to as a collector chamber. The collector chamber is accessed via an air intake, such that a suction created by rotation of the impeller within the collector chamber causes air to be drawn into the air intake.

In some designs, the motor and blower assembly is adapted to be capable of detachment from the lid of the collection canister, thereby being usable as a hand-held blower for blowing dust and debris, such as in a workshop, outdoor area, or the like.

A conventional wet/dry vac, whether of the detachable or fixed power head type, has two air flow systems. A first air flow system is established for cooling the electric motor. The second air flow system is the blower wheel or impeller airflow, which affects the suction performance of the vac (and the blowing performance, for those vacs which are adaptable or convertible between and vacuum and a blower). It is the latter airflow system to which the present invention is primarily applicable, and unless otherwise noted herein, the terms "airflow" and "airflow system" shall be intended to refer to the blower wheel or impeller airflow of a vac.

Typically, the motor for a wet/dry vac operates at relatively high speeds, on the order of 20,000 revolutions per minute (RPM). Those of ordinary skill in the art will appreciate that such motors can be very noisy in operation. The noise is heightened by the effects of the bladed impeller turning at the speed of the motor, and by the airflow through the vac. The most predominant noise made by vacs having a scroll-type collector chamber occurs at or around a specific audio frequency, referred to as the "blade passing frequency." The blade passing frequency is computed according to the following formula:

$$\text{Blade Passing Frequency} = \text{Rotation of Impeller(revolutions per second)} \times \text{Number of Impeller Blades.}$$

Thus, for a vac having a motor which turns at 19,000 to 20,000 revolutions per minute (i.e., approximately 316.66 to 333.33 revolutions per second) and having an impeller or blower wheel with seven blades, the blade passing frequency is on the order of approximately 2217 to 2333 Hz. This is well within the range of human audibility, and the noise level at this pitch can be irritating indeed.

It has heretofore been generally understood that the more obvious steps that can be taken to reduce or minimize the noise level of an operating vac have a deleterious effects upon the operation and performance of the vac. For example, reducing the speed of the motor, reducing the number of impeller blades, or reconfiguring the geometry of the airflow path to reduce the velocity of the air would all tend to degrade the performance of the vac, in terms of the suction strength and volume of air moved.

SUMMARY OF THE INVENTION

In view of the foregoing, the present invention is directed to a wet/dry vacuum appliance having an airflow system configured to achieve a reduction in operating noise without adversely affecting the operational performance of the appliance.

In accordance with one aspect of the present invention, an improved collector scroll geometry is provided which increases air performance while at the same time isolates the impeller from physical features which would tend to increase noise levels at the blade passing frequency.

In accordance with another aspect of the invention, a vac's power head housing is provided having a geometry cooperative with the collector scroll to further minimize noise-inducing interaction between the impeller blades and physical features prone to increase operating noise levels.

Experimental test results summarized in the materials comprising the above-referenced provisional patent application to which this disclosure corresponds reflect substantial improvements in both air-handling performance and noise reduction upon application of the principles of the present invention.

BRIEF DESCRIPTION OF THE DRAWINGS

Various features and aspects of the present invention will perhaps be best appreciated with reference to detailed descriptions of specific embodiments of the invention, when read in conjunction with the accompanying drawings, wherein.

DETAILED DESCRIPTION OF A SPECIFIC EMBODIMENT OF THE INVENTION

In the disclosure that follows, in the interest of clarity, not all features of actual implementations are described. It will of course be appreciated that in the development of any such actual implementation, as in any such project, numerous engineering decisions must be made to achieve the developers' specific goals and subgoals (e.g., compliance with system- and business-related constraints), which will vary from one implementation to another. Moreover, attention will necessarily be paid to proper engineering practices for the environment in question. It will be appreciated that such a development effort might be complex and time-consuming, but would nevertheless be a routine undertaking for those of ordinary skill in the relevant fields.

Figure 1:
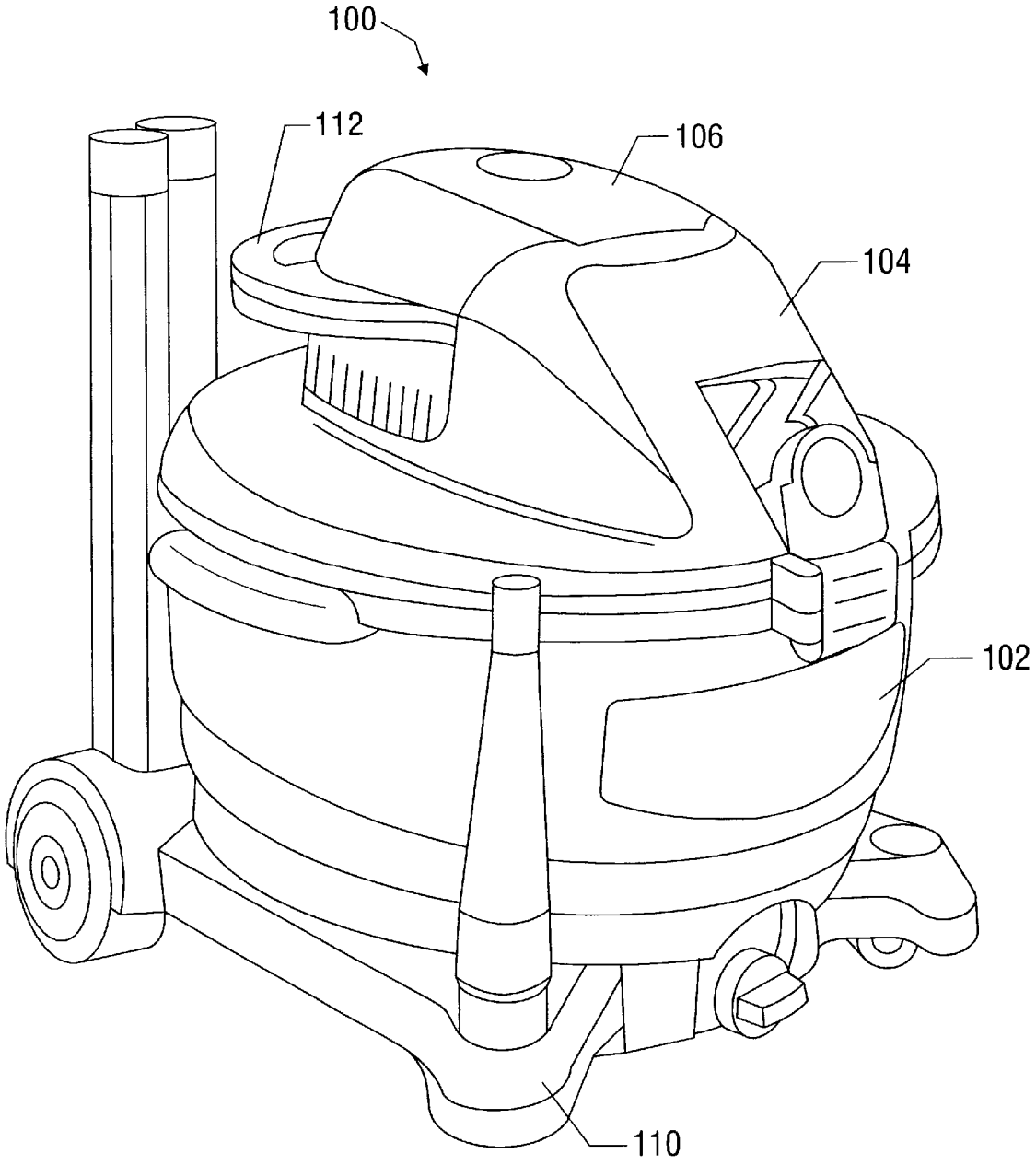
FIG. 1 is a perspective view of a wet/dry vacuum in accordance with one embodiment of the invention.

As shown in FIG. 1, wet/dry vacuum 100 in accordance with one embodiment of the invention comprises three main components: a canister, designated with reference numeral 102, a lid designated with reference numeral 104, and a power head designated with reference numeral 106. The presently disclosed embodiment of the invention comprises a wet/dry vacuum in which power head 106 is detachable from lid 104, such that the power head 106 can be separately utilized as a blower. It will be appreciated by those of ordinary skill in the art having the benefit of the present disclosure, however, that the present invention is by no means limited to removable power head vacuums, and it would be a matter of routine engineering to those of ordinary skill in the art to adapt the teachings of the present disclosure to vacuums having non-detachable power heads.

Wet/dry vacs with removable power heads are well-known, and at least several varieties of such vacs are commercially available. Power head 106 is mountable in a sealed relationship with vacuum lid 104 disposed above the canister. When power head 106 is separated from lid 104, it is adapted to receive a hose, wand, or the like at an air outlet thereof (to be described in further detail below), so as to be useful as a blower. The above-referenced Tomasiak '769 patent discloses another example of a wet/dry vac having a detachable power head.

Figure 2:
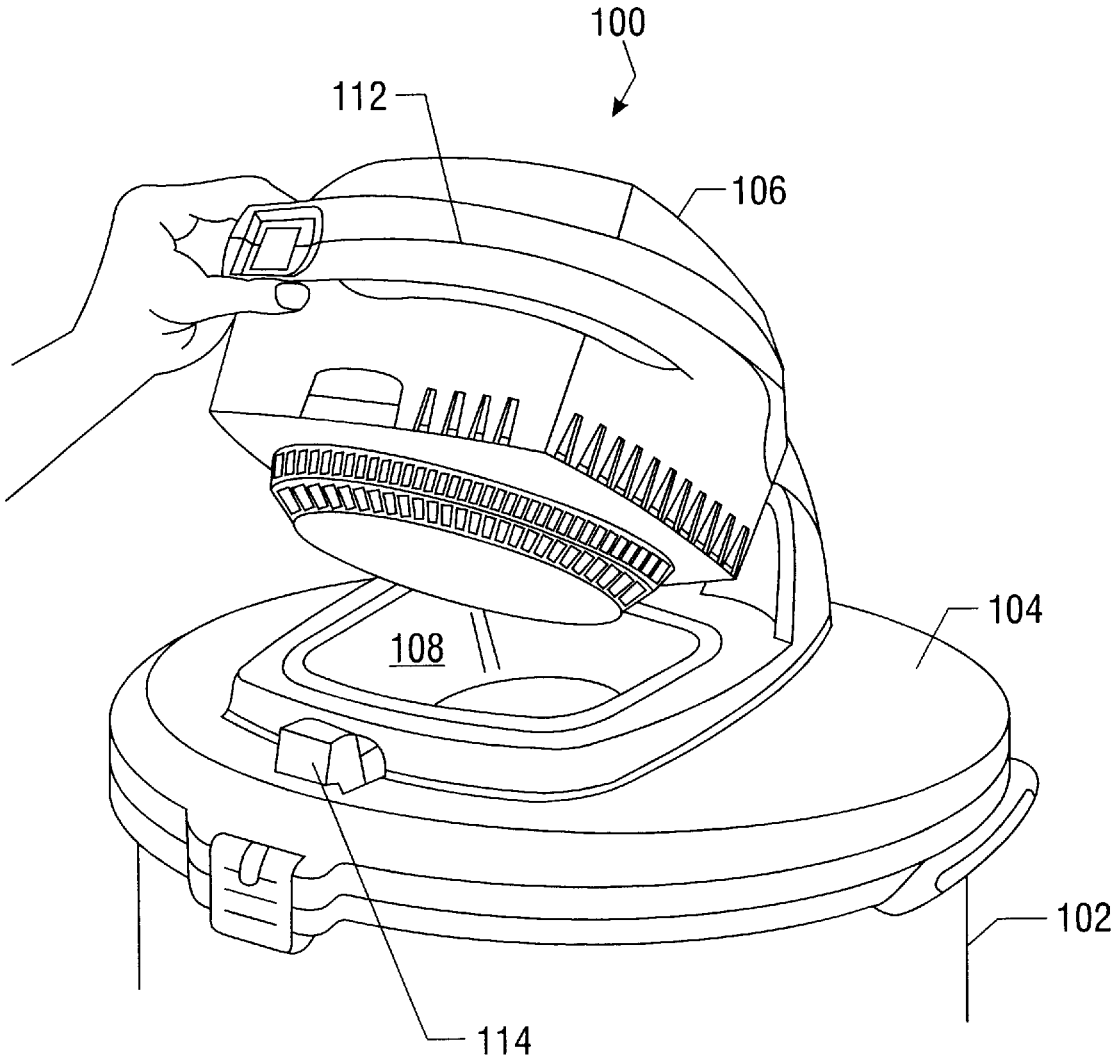
FIG. 2 is a perspective view showing the wet/dry vacuum of FIG. 1 while a detachable power head portion thereof is being detached therefrom.

With continued reference to the Figures, and in particular to FIG. 2, lid 104 is configured so as to define a recess or pocket 108, so as to be capable of receiving detachable power head 106 therein. One or more latches 114 may be provided for securing power head 106 within recess 108.

In the presently disclosed embodiment of the invention, canister 102 and lid 104 are preferably made of moldable plastic, such as polypropylene, polyethylene, or the like. Because of the configuration of canister 102 and lid 104 and their ability to cooperatively resist negative pressure forces, the walls of canister 102 are able to be reasonably thin (on the order of 0.150 inches or so). This advantageously allows for efficient and reproducible molding and short molding cycle times.

Canister 102 the presently disclosed embodiment of the invention preferably has a capacity of 12 to 16 gallons or so, although it is to be understood that the principles of the present invention can be advantageously applied to vacuums having canisters of essentially any size.

As shown in the Figures, it is contemplated that canister 102 can be adapted to accept a caster assembly 110 around the base thereof, in a more or less conventional manner, to allow for convenient mobility of the wet/vac system. A suitable caster assembly, which additionally provides for convenient accessory storage, is disclosed in co-pending U.S. Pat. No. 5,924,165, entitled "Improved Caster Foot with Accessory Storage" which application is hereby incorporated by reference in its entirety.

Referring in particular to FIG. 2, when it is desired to utilize power head 106 as a blower, power head 106 may be detached from lid 104, as will be hereinafter described in further detail. A handle 112 is formed in power head 106, such that power head 106 may be conveniently grasped with one hand, with an air outlet port facing generally forward of the user. In the blower mode of operation, blower attachments, such as extension wands, blower nozzles and the like, may be attached to the air outlet port, enabling the user to direct the stream of air exhausted from power head 106

As those of ordinary skill in the art will appreciate, for a blower/vac having a detachable power head, it is desirable to provide a latching mechanism which, while reliably securing the power head to the canister lid during operation as a vacuum, also allows the power head to be easily released from the canister lid when it is desired to utilize the power head as a blower. The power head latch for vacuum 100 in the presently disclosed embodiment of the invention is designated with reference numeral 114 in the Figures. Another example of a prior art latching mechanism is disclosed in U.S. Pat. No. 5,611,107 to Tomasiak et al., entitled "Latching Mechanisms for Wet/Dry Utility Vacuum Cleaner With Detachable Blower."

As noted above, a wet/dry vacuum has two airflow systems. One is the motor cooling system, and the other is the blower wheel airflow, which is associated with the suction and blowing performance of the vacuum. It is the latter airflow system to which the present invention is primarily related.

Figure 3:
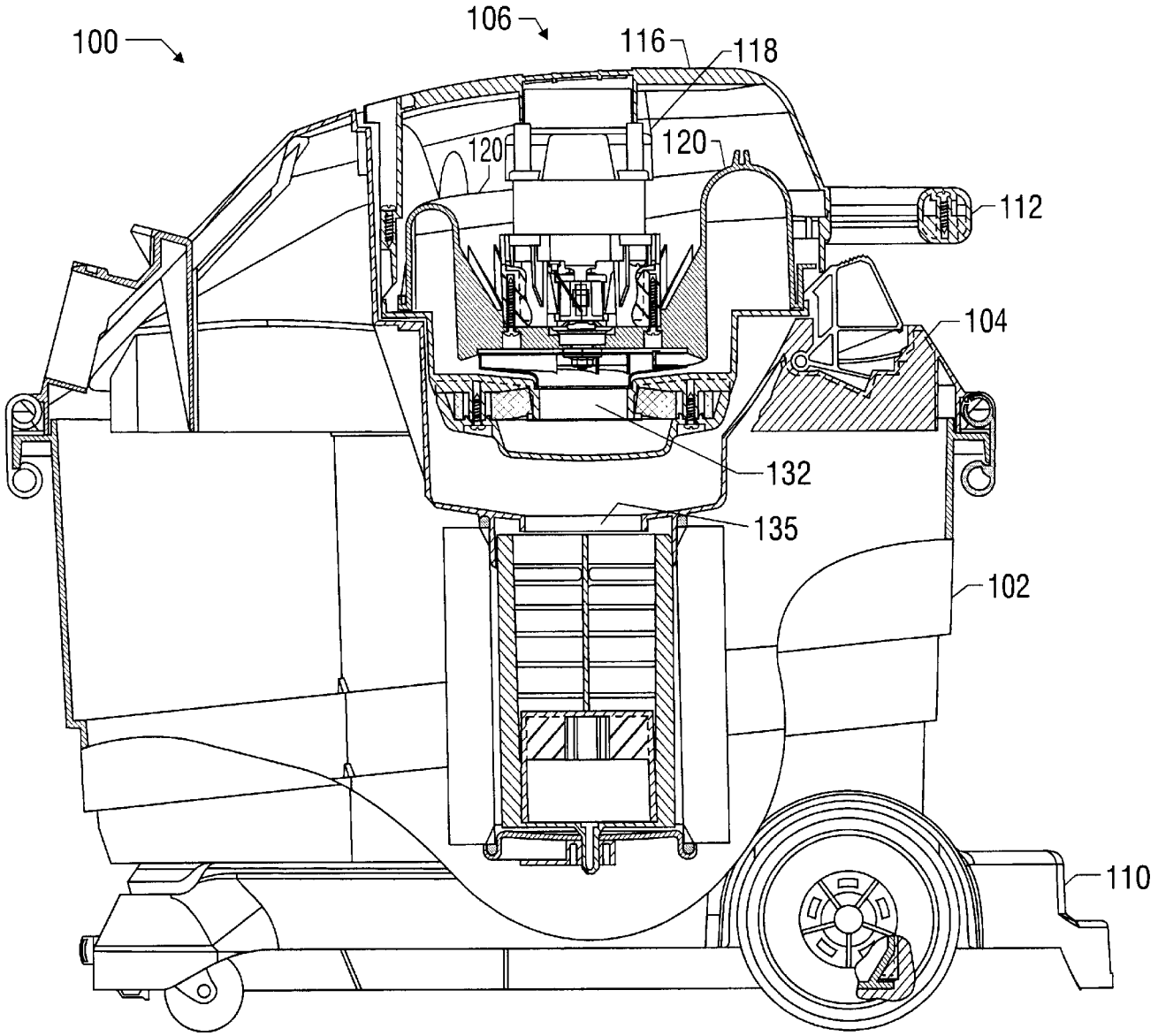
FIG. 3 is a partially-cut away side view of the wet/dry vacuum of FIG. 1, showing certain internal components of the power head thereof.

As with conventional wet/dry vacuum implementations, power head 106 largely defines the blower wheel airflow path referred to above. FIG. 3 is a partially-cut away side view of the wet/dry vacuum of FIG. 1, showing certain internal components of power head 106. As can be seen in FIG. 3, power head 106 comprises a rigid outer housing 116 within which are disposed a motor and blower assembly 118 and a collector scroll 120.

Figure 4:
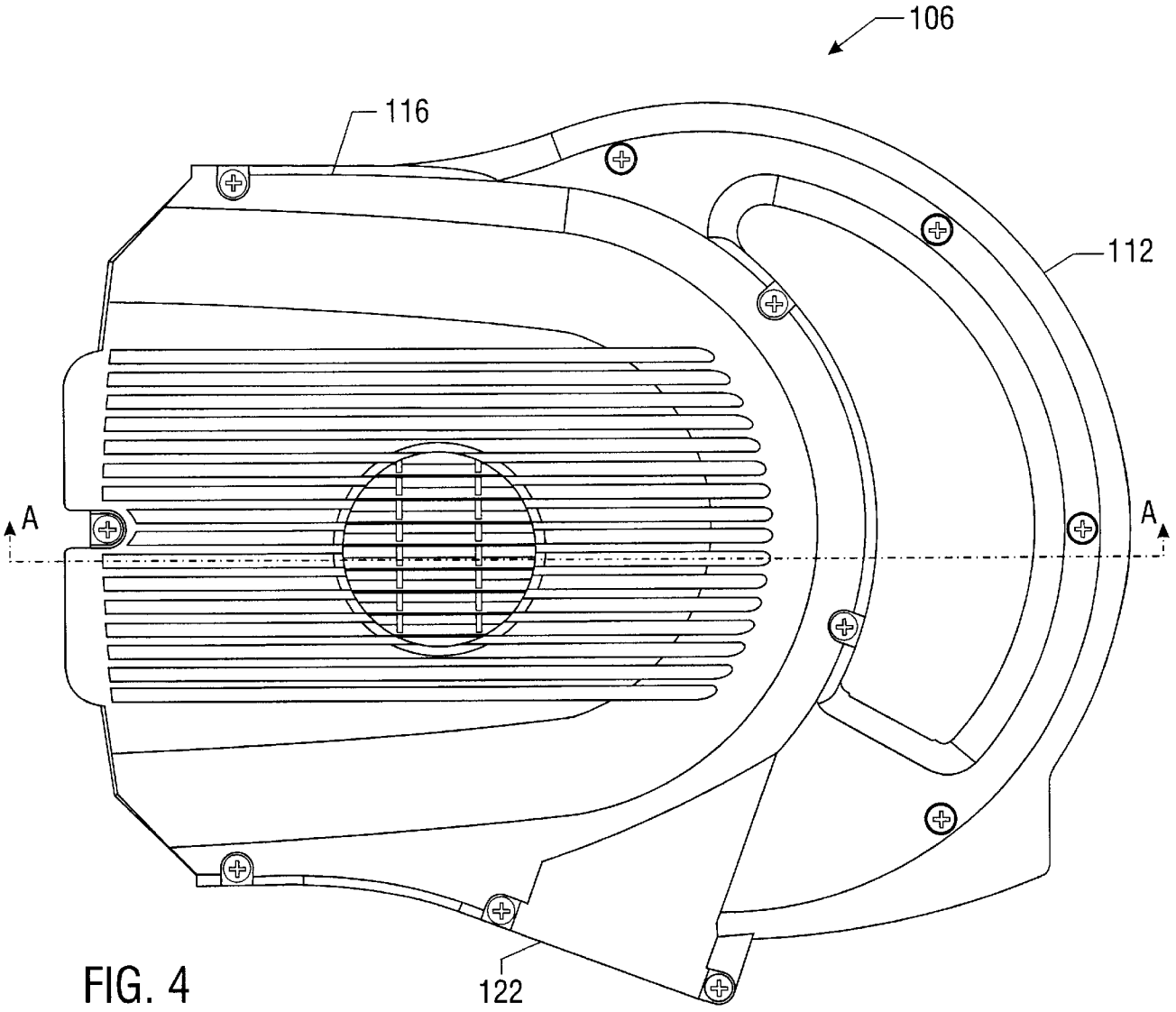
FIG. 4 is a top view of the detachable power head of the wet/dry vacuum of FIG. 1.
Figure 5:
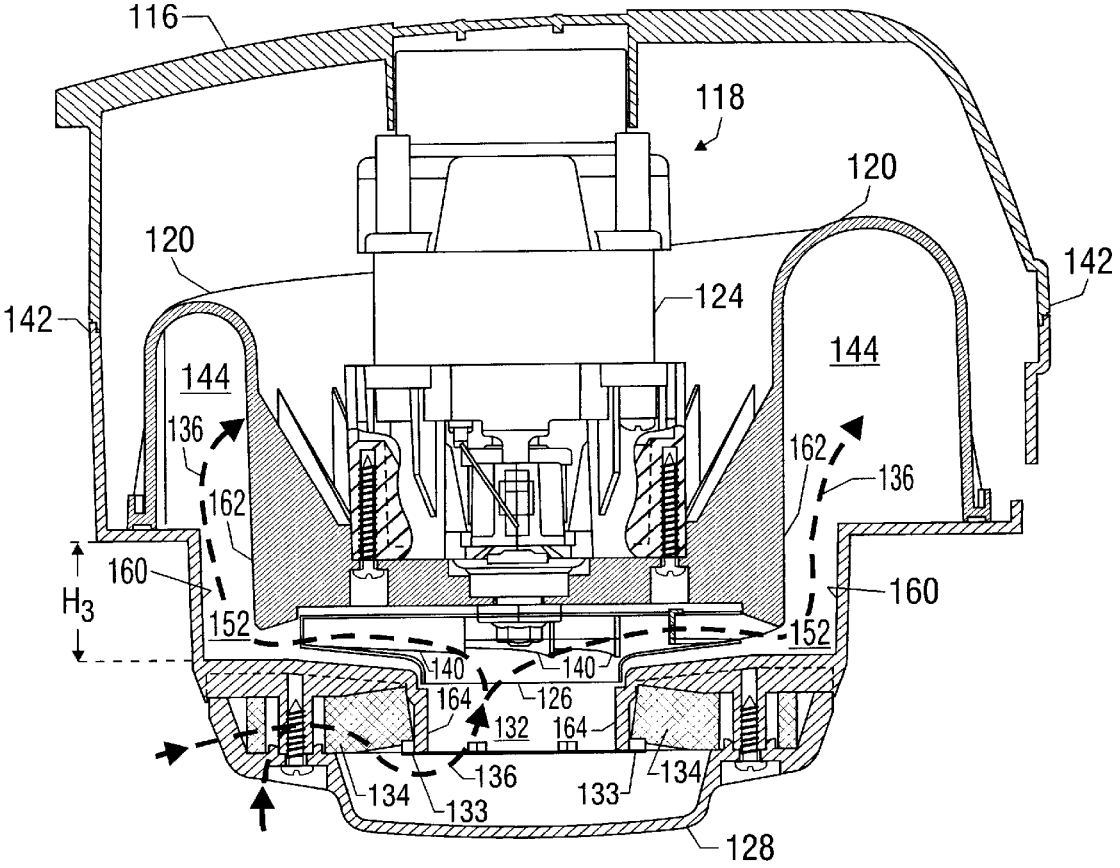
FIG. 5 is a side cross-sectional view of the detachable power head of the wet/dry vacuum of FIG. 1.

FIG. 4 is a top view of power head 106. In FIG. 4, the relationship between handle 112 and an air outlet port 122 is evident. FIG. 5 is a side, cross-sectional view of power head 106, corresponding to the section designated A—A in FIG. 4. As can be observed in FIG. 5, motor and blower assembly 118 comprises a motor 124 disposed within and rigidly affixed to collector scroll 120, and an impeller 126 coupled to the output drive shaft of motor 124.

Figure 14:
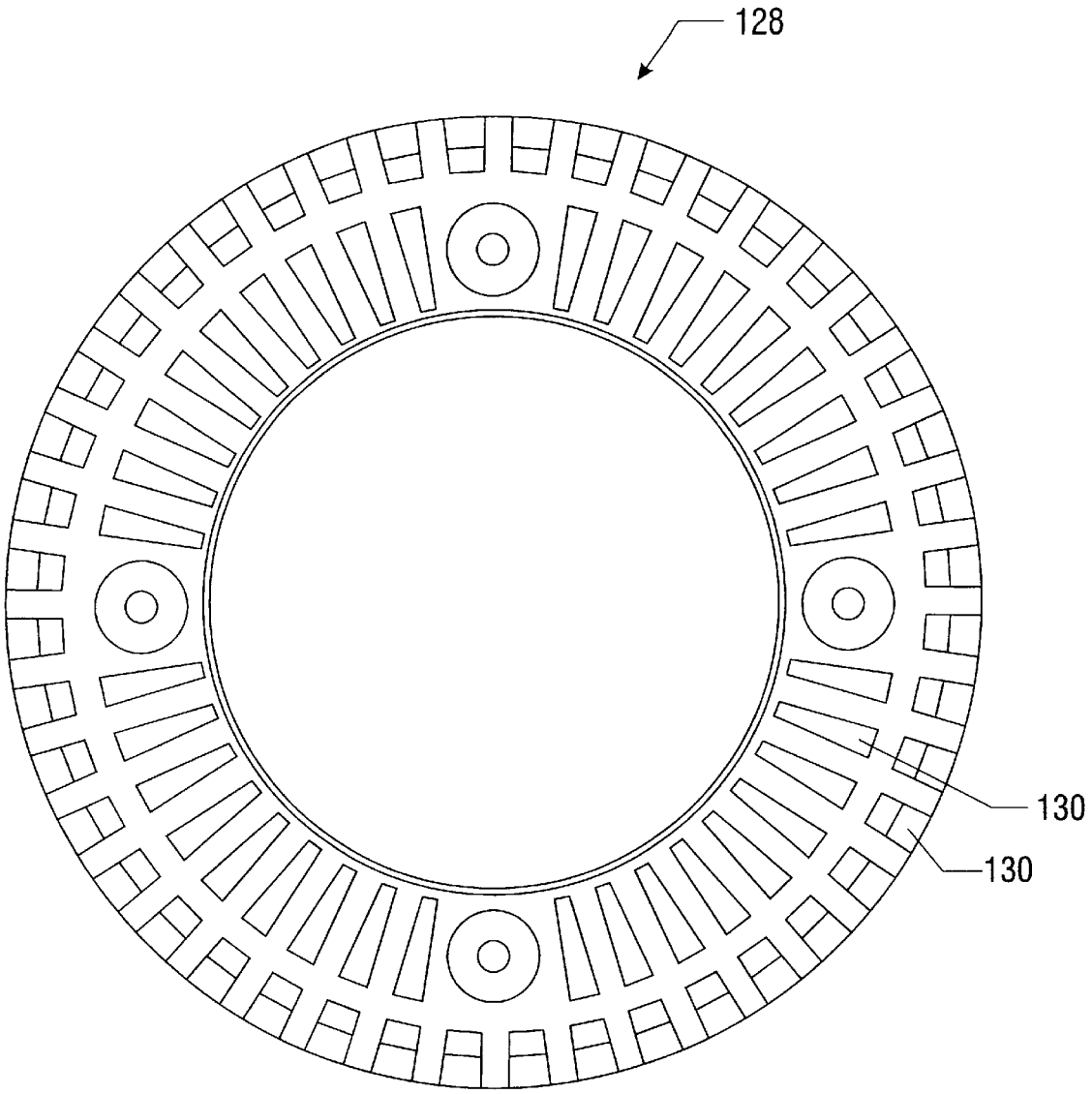
FIG. 14 is a bottom view of an air intake shield disposed on the underside of the power head in the vacuum of FIG. 1.
Figure 15:
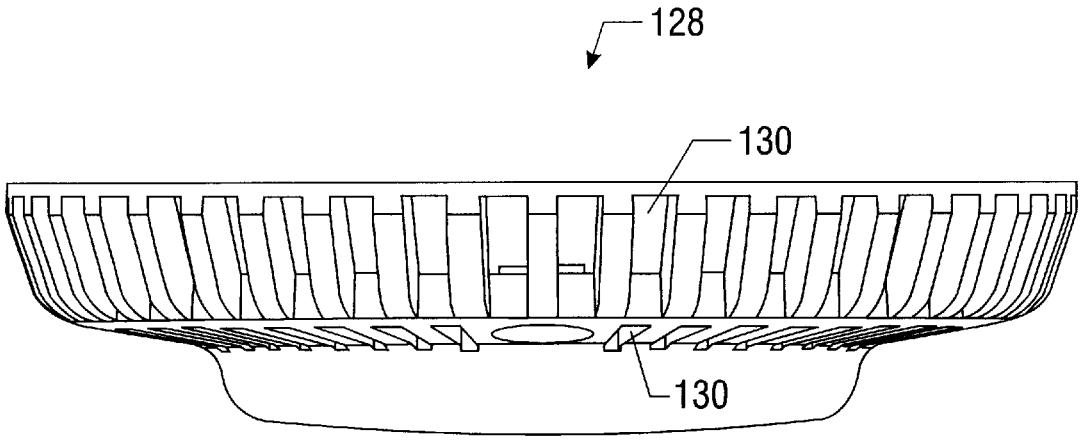
FIG. 15 is a side view of the air intake shield of FIG. 14.
Figure 16:
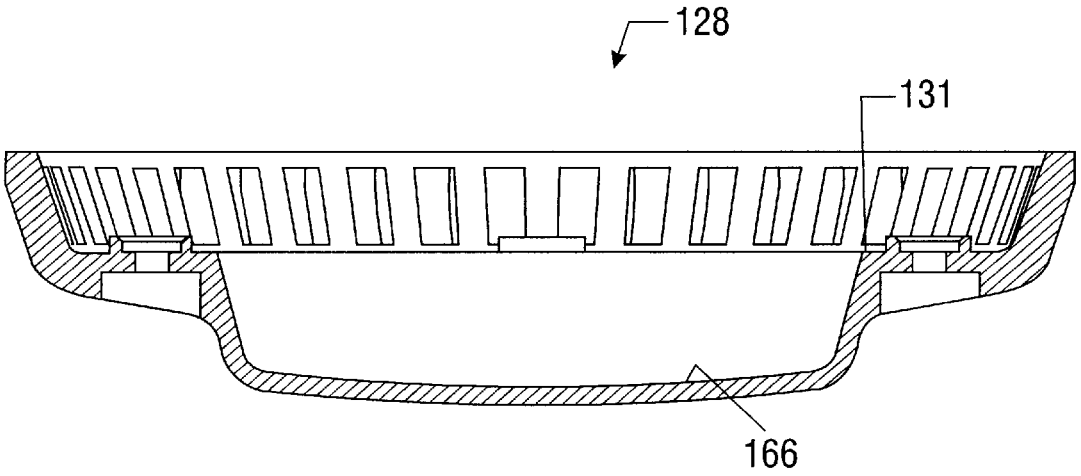
FIG. 16 is a side, cross-sectional view of the air intake shield from FIG. 14.

Also depicted in FIG. 5 is an air intake shield 128 affixed to the underside of housing 116. FIGS. 14, 15, and 16 are bottom, side, and side cross-sectional views, respectively, of air intake shield 128. As shown in FIGS. 14 through 16, air intake shield is provided with a plurality of air intake vents 130. As shown in FIG. 3, when power head 106 is secured within recess 108 of lid 104, air intake shield 128 is disposed above an air intake port 135 into canister 102. Air intake vents 130 permit air to be drawn from within canister 102 and into power head 106. When power head 106 is detached from lid 104, air intake vents 130 permit air to be drawn into power head 106 but prevent fingers and debris from coming into injurious contact with rotating impeller 126.

Figure 17:
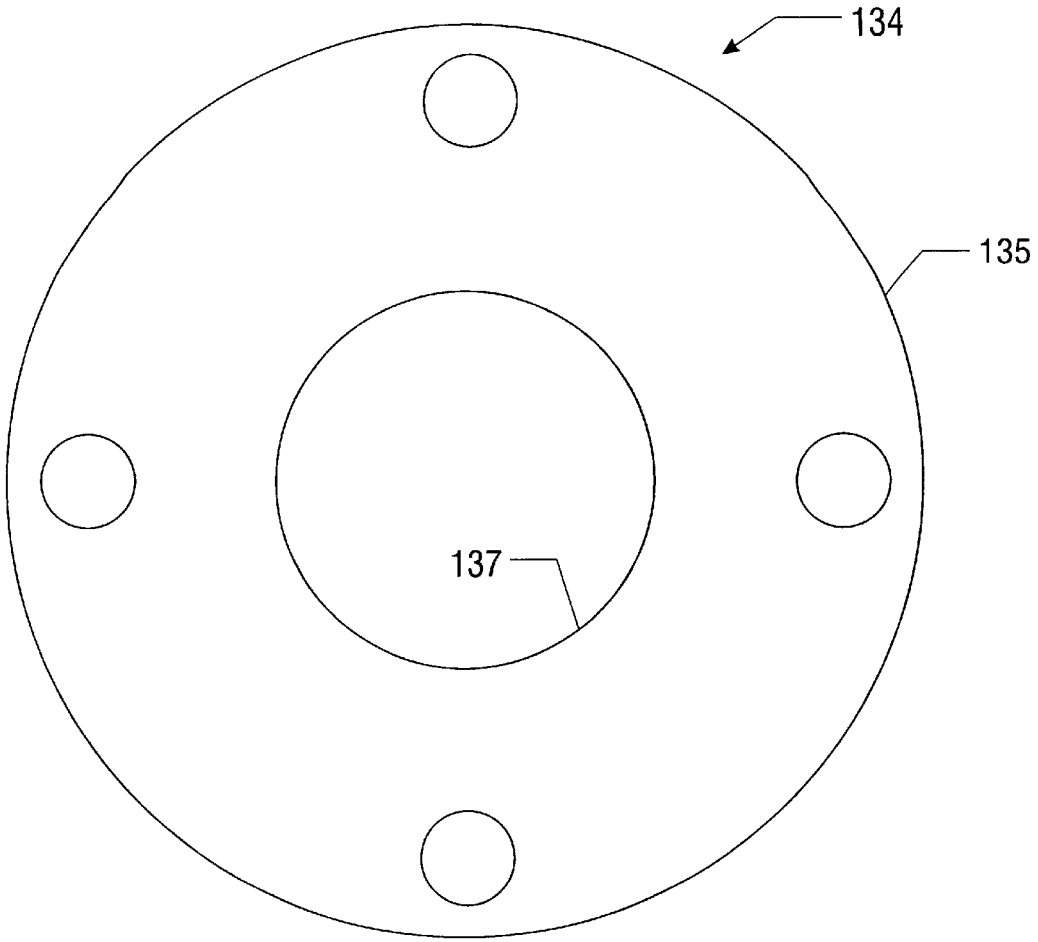
FIG. 17 is a top view of a foam pad disposed in the detachable power head of FIG. 5.
Figure 18:
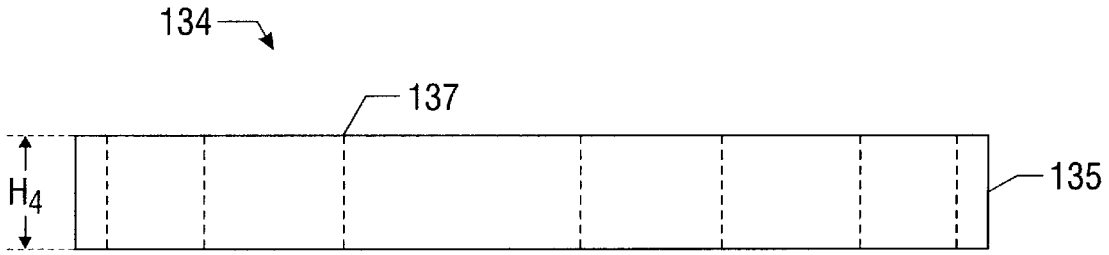
FIG. 18 is a side view of the foam pad from FIG. 17.

In accordance with one sound-dampening aspect of the presently disclosed embodiment of the invention, a substantially annular foam pad 134 is disposed between air intake shield 128 and the underside of power head housing 116. Foam pad 134 is depicted in FIGS. 17 and 18, with FIG. 17 being a top view and FIG. 18 being a side view. It is to be understood that there would be no need for air intake shield 128 and foam pad 134 in embodiments of the invention in which power head 106 was not detachable. Referring to FIG. 16 as well as to FIG. 5, it is apparent that an inner surface designated with reference numeral 131 in FIG. 16 serves to secure the outer edge 135 of foam pad 134 against the bottom of power head housing 116. Similarly, in FIG. 5 it can be seen that tabs designated with reference numeral 133 function to secure the inner edge 137 of foam pad 134 in place.

Figure 20A:
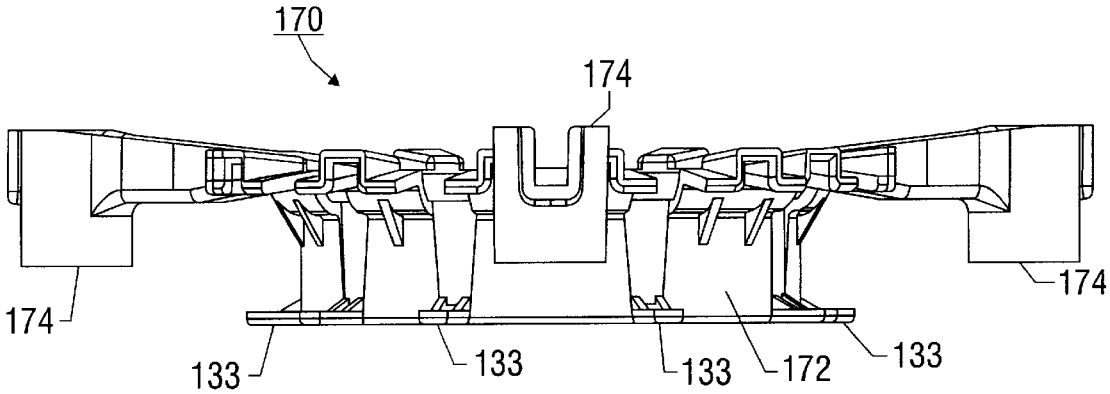
FIG. 20*a* is a side view of a foam pad retaining element in accordance with one embodiment of the invention.
Figure 20B:
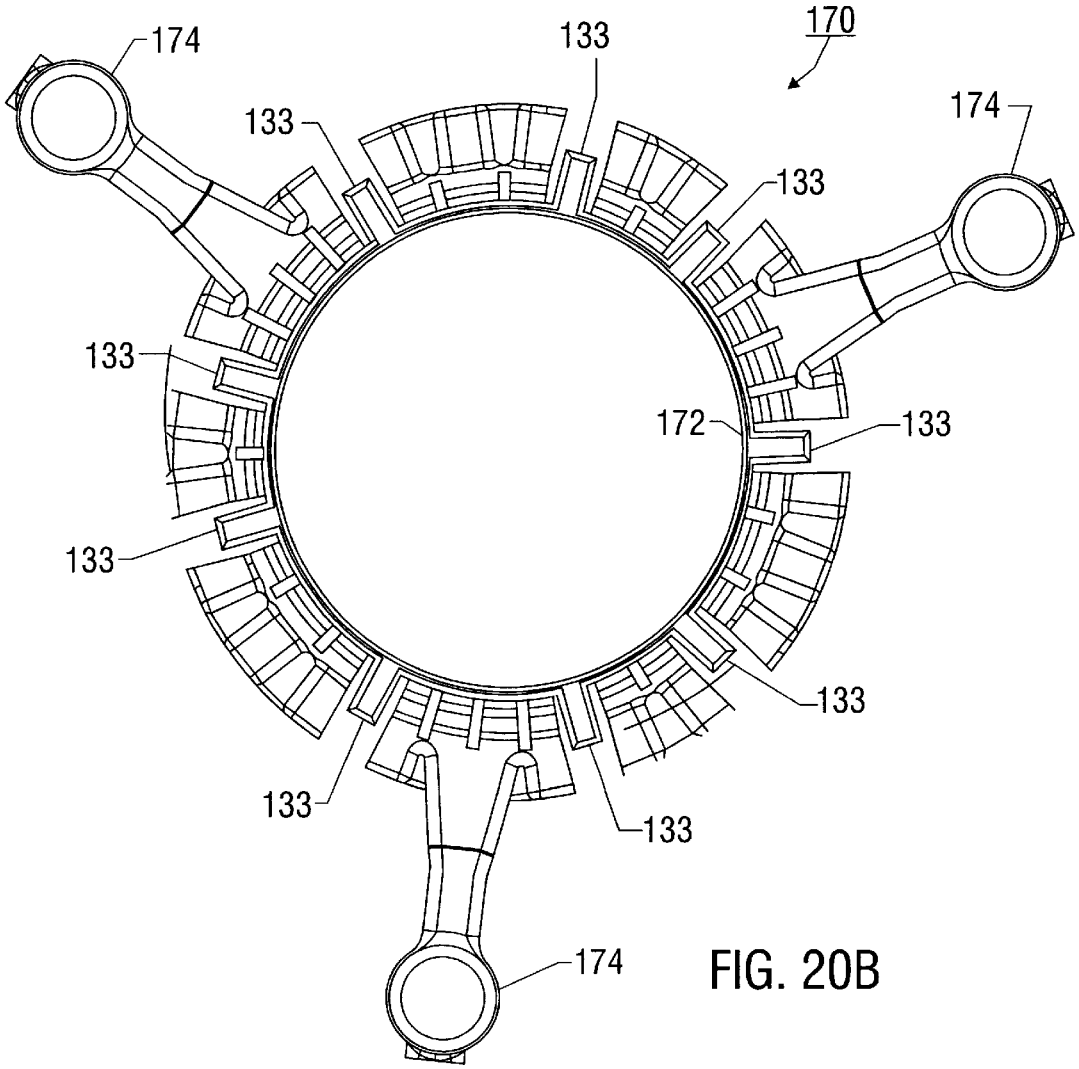
FIG. 20*b* is a bottom view of the foam pad retaining element from FIG. 20*a*.

In one embodiment, foam pad retaining tabs 133 are integral with the bottom portion of housing 116. In another embodiment, a separate foam pad retaining element 170 is provided. FIGS. 20*a* and 20*b* are side and bottom views, respectively of foam pad retaining element 170. As can be seen in FIGS. 20*a* and 20*b*, foam pad retaining element 170 has a substantially cylindrical body 172 sized to concentrically mate with a cylindrical element 164 of the bottom portion of housing 116, visible in FIG. 5. Foam pad retaining tabs 133 project radially outward from the bottom of cylindrical body 172 of retaining element 170. A plurality of attachment fins 174 project radially outward from the top of cylindrical body 172, providing a means for retaining element 170 to be secured between air intack shield 178 and the bottom of housing 116. In either embodiment, tabs 133 function to secure the inner perimeter 137 of foam pad 134 to prevent foam pad 134 from moving as air flows into housing 116.

A dashed line designated with reference numeral 136 in FIG. 5 illustrates a portion of the path of air flow within power head 106. In particular, upon being drawn in through air intake vents 130, air is drawn through foam pad 134, into air intake port 132 in the underside of power head housing 116, and through impeller 126 into collector scroll 120. In a conventional configuration, impeller 126 is provided with a plurality of blades 140, such that rotation of impeller 126 generates a vacuum pressure which leads to air being drawn into power head 106.

With continued reference to FIG. 5, it can be seen that collector scroll 120 is attached to and cooperates with the bottom portion of power head housing 116 to define a collector chamber designated with reference numeral 144. An important aspect of the present invention from the standpoint of reducing operation noises of vacuum 100 relates to the particular configuration of collector scroll 120 and hence the shape of collector chamber 144. Collector scroll 120 will be hereinafter described with reference to FIGS. 6 through 13.

Figure 6:
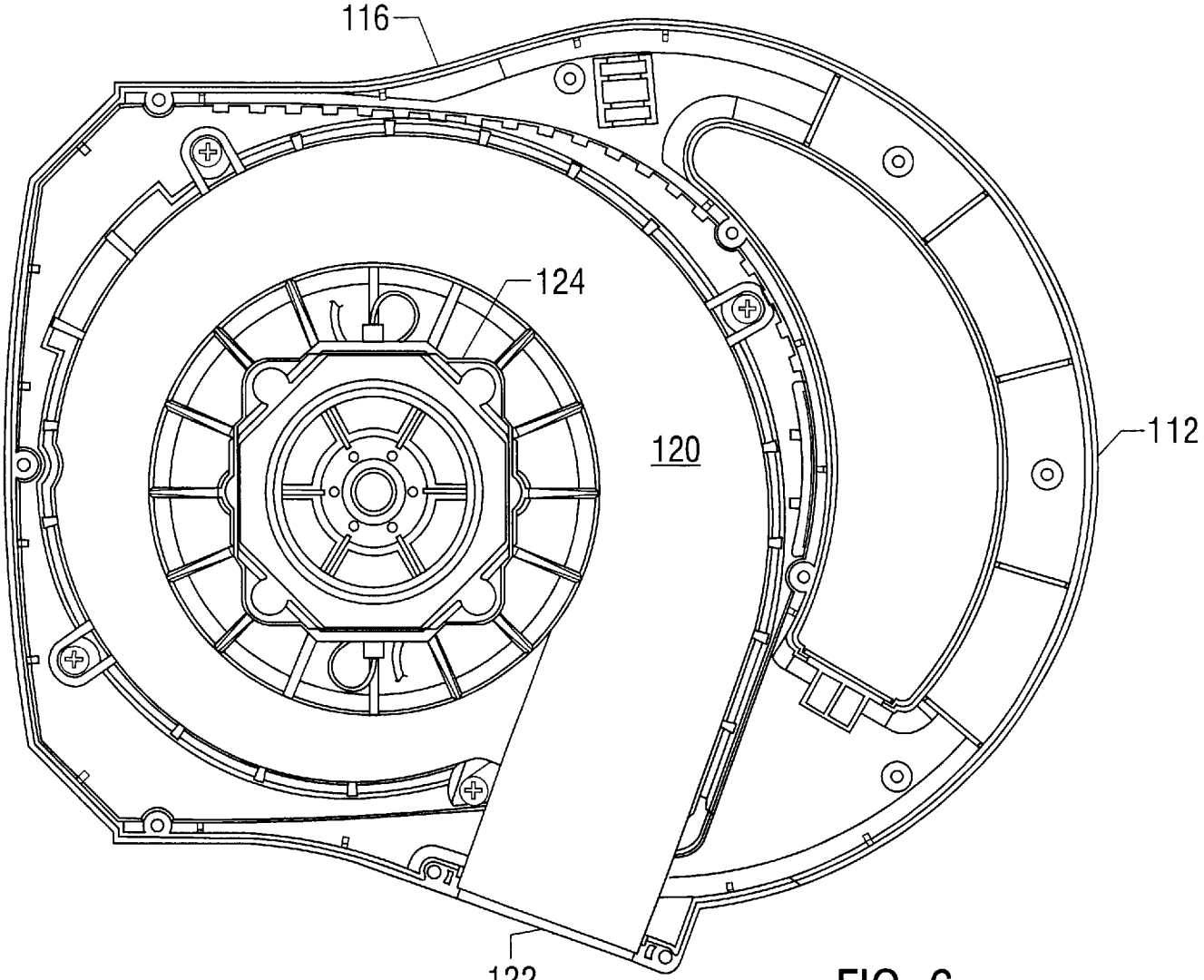
FIG. 6 is a top view of the detachable power head of the wet/dry vacuum of FIG. 1 with the motor cover thereof having been removed.

FIG. 6 is a top view of power head 106 in accordance with the presently disclosed embodiment of the invention, wherein an upper half of housing 116 has been removed. (In the presently disclosed embodiment of the invention, housing 116 is comprised of an upper half and a lower half which mate at a seam designated with reference numeral 142 in FIG. 5. Such an arrangement is common for appliance housings, and it is believed that those of ordinary skill in the art will readily appreciate the benefits of such a design.)

Figure 7:
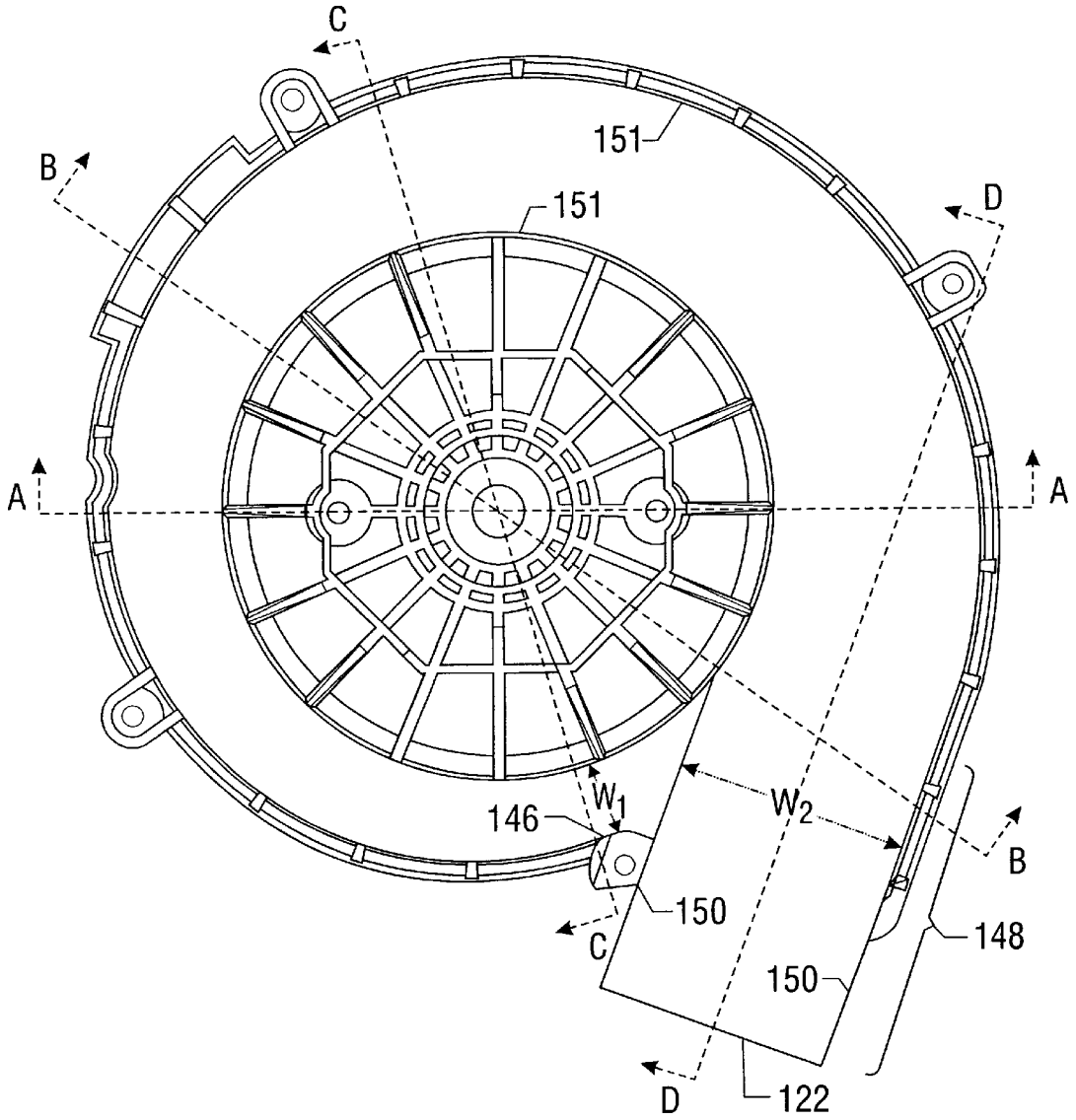
FIG. 7 is a top view of the collector scroll in the wet/dry vacuum of FIG. 1.

FIG. 7 is a top view of collector scroll 120 shown in isolation. In FIG. 7, it can be seen that collector scroll 120 from the top has a substantially helical or spiral configuration. Further, it can be observed in FIG. 6 that the width of collector scroll 120 gradually expands as it spirals around the area occupied by motor 124. In particular, as shown in FIG. 7, at a "cut-off" area designated with reference numeral 146, collector scroll 120 has a width $W_1$, while at an outlet portion designated with reference numeral 148, collector scroll 120 has a substantially greater width $W_2$. In one embodiment, dimension $W_2$ is at least twice dimension $W_1$. A further feature of collector scroll 120 apparent from FIG. 7 is that the side wall 150 of outlet portion 148 are substantially tangent to the inner walls 151 of collector scroll 120.

Figure 8:
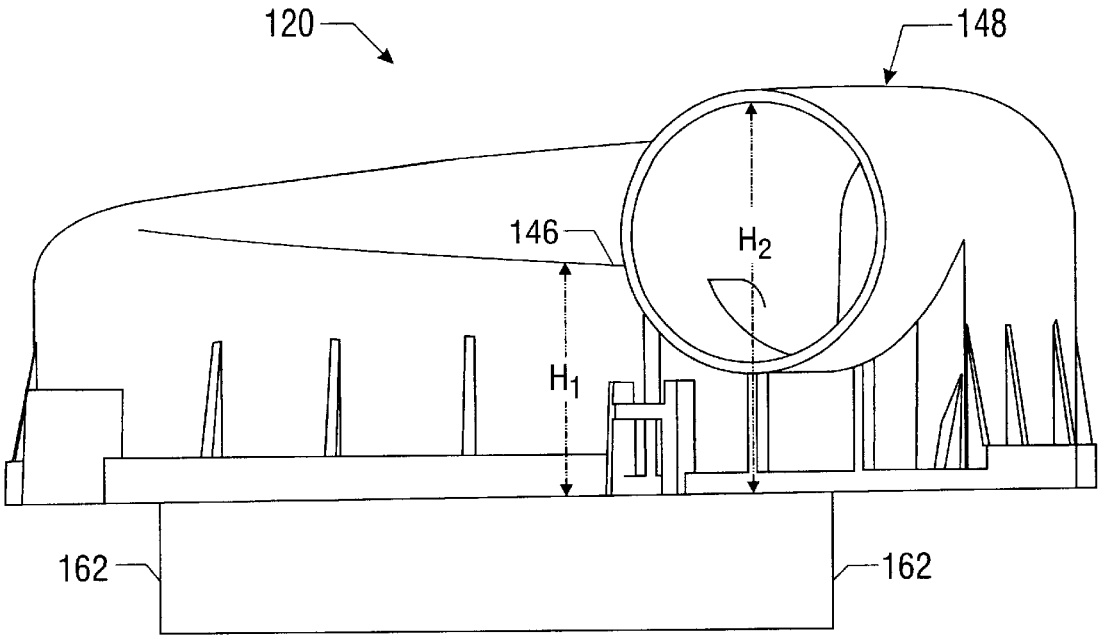
FIG. 8 is a front side view of the collector scroll from FIG. 7.
Figure 9:
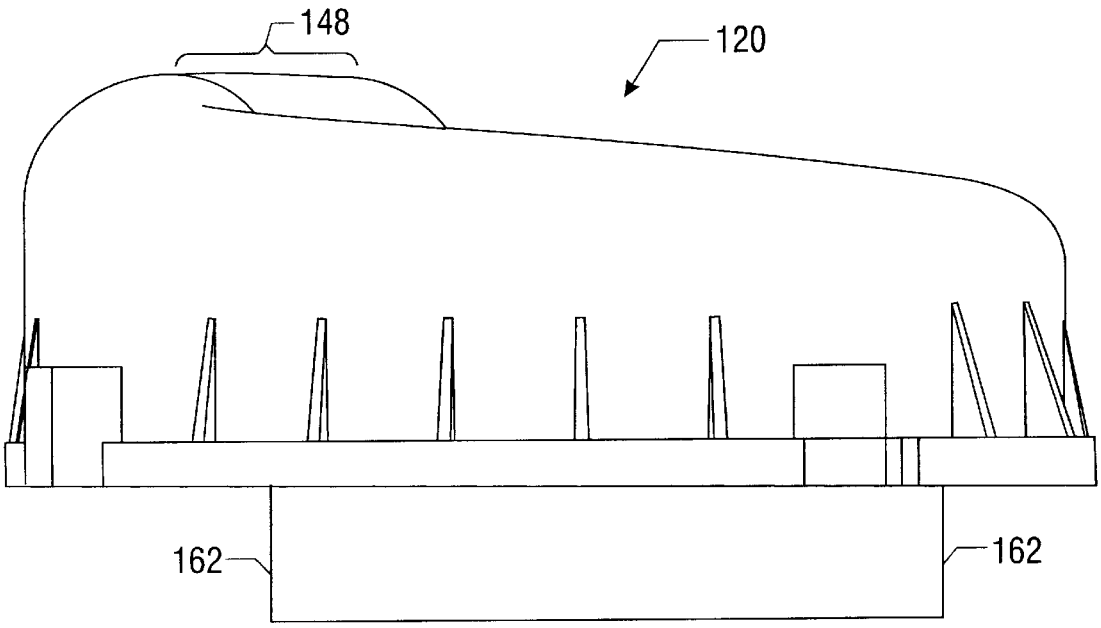
FIG. 9 is a back side view of the collector scroll from FIG. 7.

Likewise, referring to FIG. 8, it can be seen that the height of collector scroll 120 gradually expands from a height $H_1$ at cut-off area 146 to a substantially greater height $H_2$ at outlet portion 148. FIG. 9 is a rear view of collector scroll 120 from which the gradual increase in the height of collector scroll 120 can be observed. In one embodiment, dimension $H_1$ is approximately nine sixteenths of dimension $H_2$.

Figure 10:
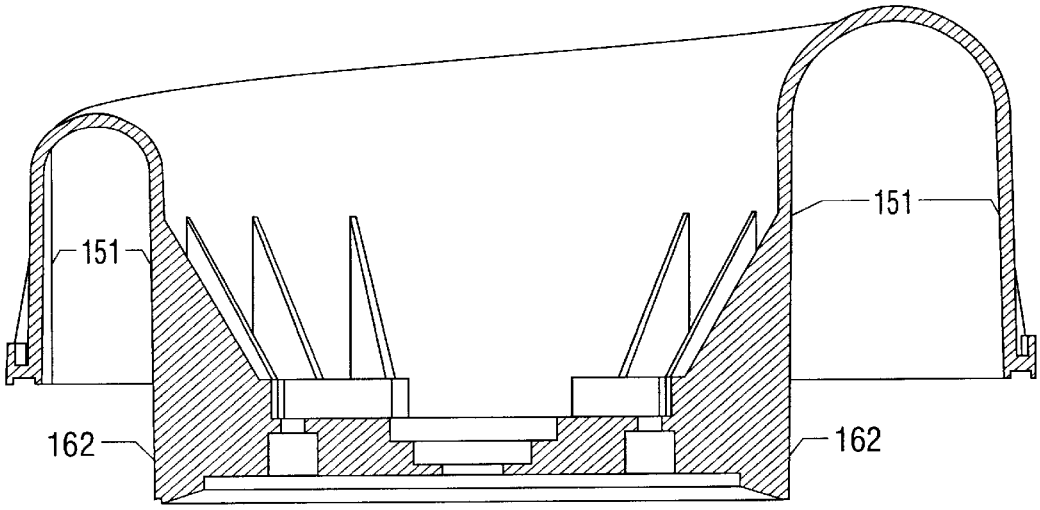
FIG. 10 is a side cross-sectional view of the collector scroll from FIG. 7.
Figure 11:
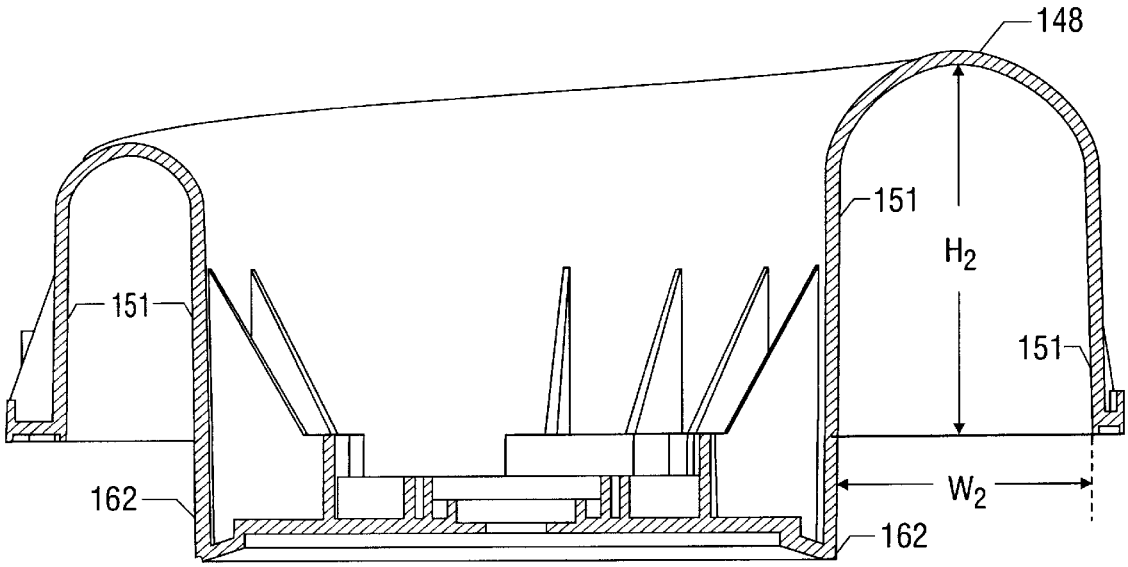
FIG. 11 is an alternative side cross-sectional view of the collector scroll from FIG. 7.
Figure 12:
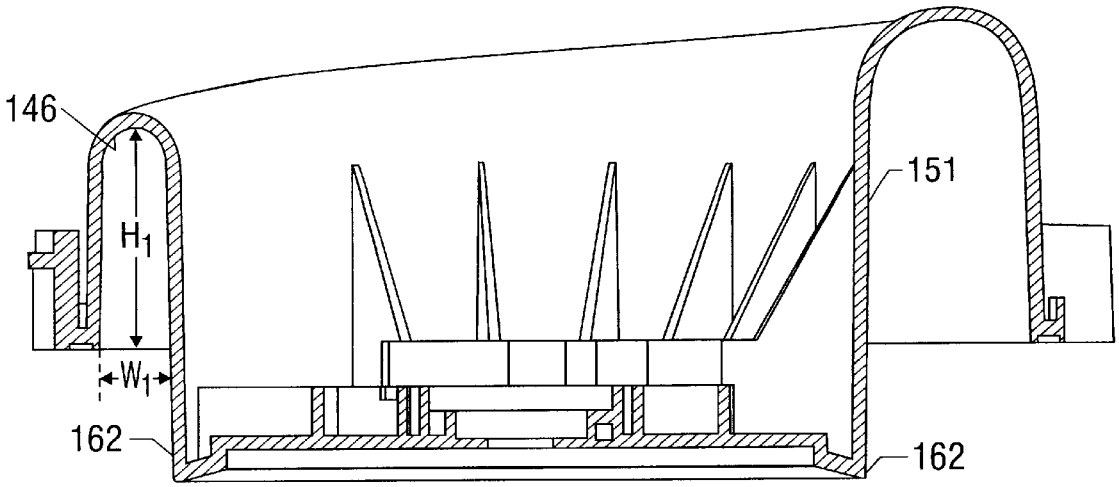
FIG. 12 is another alternative side cross-sectional view of the collector scroll from FIG. 7.
Figure 13:
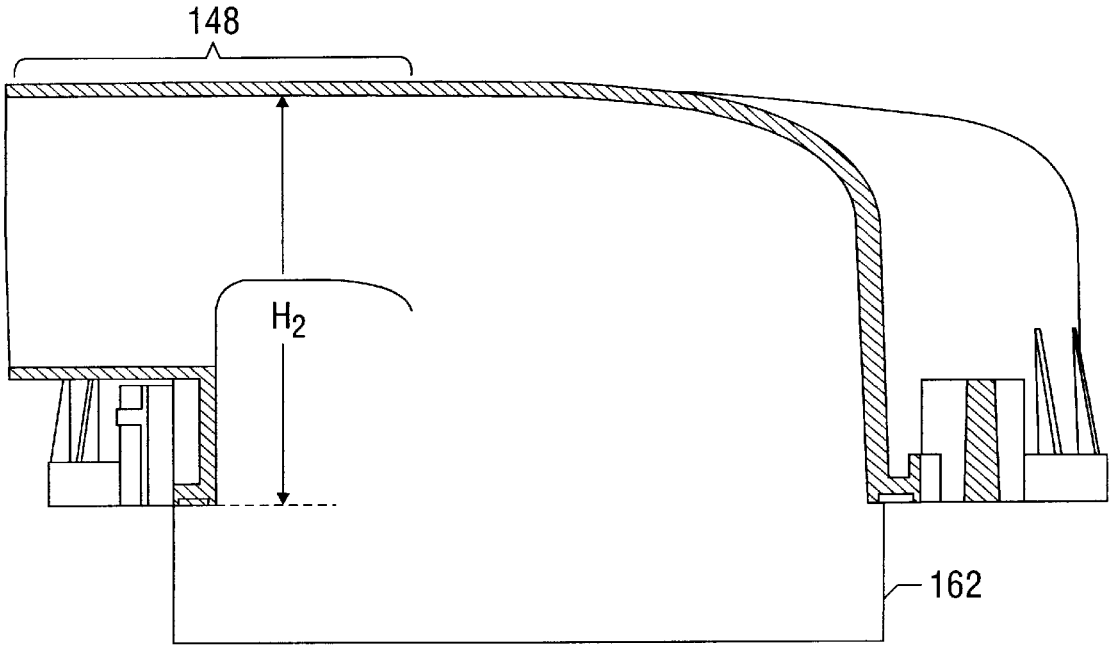
FIG. 13 is another alternative side view of the collector scroll from FIG. 12.

FIG. 10 is a cross-sectional view of collector scroll 120 corresponding to the section designated A—A in FIG. 7. FIG. 11 is a cross-sectional view of collector scroll 120 corresponding to the section designated B—B in FIG. 7. Since section B—B passes substantially through outlet portion 148 of collector scroll 120, the height $H_2$ and width $W_2$ of outlet portion 148 can be observed in FIG. 11. FIG. 12 is a cross-sectional view of collector scroll 120 corresponding to the section designated C—C in FIG. 7. 9 Since section C—C passes substantially through cut-off area 146 of collector scroll 120, the height $H_1$ and width $W_1$ of cut-off portion 146 can be observed in FIG. 12. FIG. 13 is a cross-sectional view of collector scroll 120 corresponding to the section designated D—D in FIG. 7. Again, the height $H_2$ of collector scroll 120 at outlet portion 148 can be observed, since section D—D passes through outlet portion 148.

Several aspects of vacuum 100 as thus far described are significant from the standpoint of reducing operating noise. With regard to collector scroll 120, it is to be noted that cut-off portion 146 is the closest point of collector scroll 120 to impeller 126. Those of ordinary skill in the art will appreciate that the purpose of cut-off area 146 is to help directionalize the airflow out of outlet portion 148, and minimize recirculation of air flow back within scroll 120. A common theory in this regard is that the closer cut-off area 146 is to impeller 126, the better the air performance, in terms of volume of air moved. However, it is also recognized that the closer cut off area 146 is to impeller, the louder the operation of the vacuum (especially at the blade passing frequency), while moving the cut off area 146 further away from impeller 126 tends to diminish air performance and decrease the noise. Although formulas and technology relating to cut off points and scroll profiles have been shown in the prior art relating to furnace-type (i.e., open-faced) blower wheels and liquid centrifugal pumps, these applications involve substantially different speeds than the 19,000 to 20,000 RPM motor in the presently disclosed embodiment of the invention. Published information specific to the type of closed-face blower wheel (impeller) and speeds utilized by the vacuum in accordance with the presently disclosed embodiment of the invention are not known to the inventor.

In particular, it has been found by the inventor that a dramatic increase in performance can be achieved by relaxing cut off area 146 away from the blower wheel. As noted above, maximizing this dimension runs counter to what is regarded in the prior art to be desirable.

A further notable aspect of collector scroll 120 as pertaining to the issue of noise reduction is the configuration of outlet portion 148. As noted above, outlet portion 148 is preferably substantially tangent to the inside wall 151, adjacent motor 124, of collector scroll 120. Further, as described above, there is a gradual expansion in the dimensions of collector scroll chamber 144 from cut off area 146 to outlet portion 148, with no drastic protrusions or changes in direction. As discussed above, this expansion is not only in the scroll profile (i.e., width), but also in scroll height.

Generally, the inventor has determined that noise reduction can be achieved by changing the geometry around impeller 126 to be as smooth and constant as possible. It has been observed experimentally that any non-circular profile of collector scroll 120 causes the sound level at the blade passing frequency to increase, where (as noted above) the blade passing frequency is defined as the speed of the motor in revolutions per second (RPS) multiplied by the number of blades 140 on impeller 126. In the presently disclosed embodiment of the invention, the motor speed is between 19,000 and 20,000 RPM and impeller 126 has seven blades 140, meaning that the blade passing frequency is between 2200 to 2350 Hz.

Accordingly, as can be observed in FIG. 5, collector scroll 120 and the bottom portion of power head housing 116 area configured to provide an annular volume, designated generally with reference numeral 152, which is concentric with impeller 126 and intermediate to impeller 126 and collector chamber 144. The outer wall defining annular volume 152 is defined by a cylindrical feature 160 of the lower portion of power head housing 116, while the inner wall defining annular volume 152 is a cylindrical feature 162 of collector scroll 120. Annular volume 152 can also be observed in FIG. 19, being interposed between (intermediate) impeller 126 and collector chamber 144. Annular volume 152 is what blades 140 of impeller 126 of the blowing side of impeller 126 initially react with, increasing the sound quality by avoiding placement of impeller 126 in direct proximity to the non-circular collector chamber 144.

Figure 19:
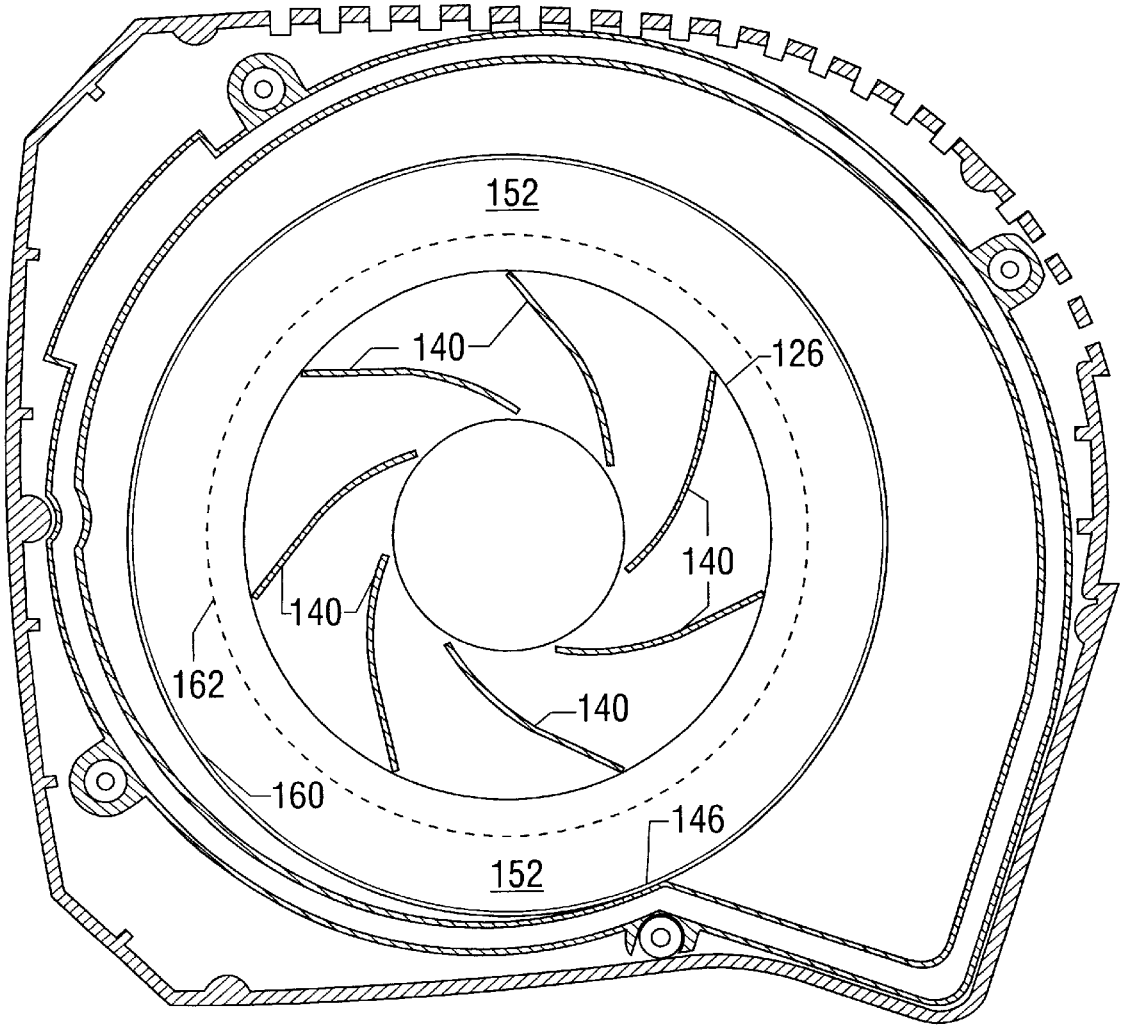
FIG. 19 is a partially cut-away view of the detachable power head of FIG. 5.

The diameter of the outer wall 160 of annular volume 152 may vary; however in the presently disclosed embodiment of the invention, the diameter of outer wall 160 is preferably coincident to the closest portion of collector scroll 120 to impeller 126, i.e., cut off area 146, as can be observed in FIG. 19.

Also, the height of annular volume 152, designated as dimension $H_3$ in FIG. 5, should at least extend above impeller 126. In the presently disclosed embodiment, dimension $H_3$ is on the order of 1.45 inches. Thus, air flow created by impeller 126 travels up through annular volume 152 before being exposed to non-circular features such as the collector chamber 144 of collector scroll 120, which, although smoothly curved, is not strictly circular and concentric with impeller 126. Maximizing dimension $H_3$ further advantageously maximizes the height of the shortest part of the collector scroll above the bottom of housing 116, i.e., maximizes the dimension $H_3$ plus $H_1$. Smaller values for $H_3$ (and hence for $H_3$ plus $H_1$) were shown experimentally to increase the sound level at the blade passing frequency. Also, notably, maximizing dimension $H_3$, at least to a point, did not result in degradation of the air-handling performance of vacuum 100.

In accordance with a further aspect of the invention, noise reduction was also achieved through refinement of certain characteristics of air intake into power head 106. As noted above, any protrusions or irregularities in the vicinity of impeller 126 can tend to increase noise levels, especially at the blade passing frequency. Unless properly located, foam pad 134, and tabs 133 themselves could contribute to generation of noise. Accordingly, and in accordance with one aspect of the invention, the bottom portion of housing 116 is configured such that the air intake port 132 (shown in FIG. 5) is a substantially cylindrical air path defined by side walls 164 having a height corresponding to the thickness $H_4$ of foam pad 134. Notably, air intake port 132 is substantially adjacent to and concentric with impeller 126. The edge 137 of foam pad 134 is held behind and below side walls 164 by tabs 133. Tabs 133 are also disposed behind and below side walls 164 to prevent noise generation. Furthermore, the use of air intake shield 128 to secure the outer perimeter 135 of foam pad 134, as described above, eliminates the need for any additional components to perform this function of securing foam pad 134. Further, the profile of air intake shield 128 incorporates a smoothly-curved indented circular portion designated with reference numeral 166 in the cross-sectional view of FIG. 16, for allowing air to pass into intake port 132. Indented portion 166 defines a substantially circular air intake chamber 176 adjacent air intake port 132. Air intake chamber is preferably concentric with impeller 126 and its walls are smoothly curved, in keeping with the objective of ensuring that all features immediately adjacent to impeller 126 are circular and smooth.

From the foregoing detailed description of specific embodiments of the invention, it should be apparent that a wet/dry vacuum appliance having various features for minimizing operational noise and enhancing air-handling performance has been disclosed. Although a specific embodiment of the invention has been described herein in detail, this has been done solely for the purposes of illustrating various aspects of the invention, and is not intended to be limiting with respect to the scope of the invention. It is contemplated that various substitutions, alternations, and/or modifications, including but not limited to those design variations which may have been specifically mentioned herein, may be made to the disclosed embodiment without departing from the spirit and scope of the invention, as defined in the following claims.

What is claimed is:

1. A wet/dry vacuum appliance, comprising:

a collection canister;

a lid adapted to be disposed upon said collection canister;

a power head, disposed on said collection canister, said power head comprising a motor and impeller assembly rigidly disposed within a power head housing, said power head housing having an air outlet port therein;

a collector scroll, coupled to said motor and impeller assembly and cooperating with said power head housing to define a substantially spiral collector chamber for directing air out of said air outlet port;

wherein said collector scroll and said power head housing further cooperate to define a substantially annular volume around and concentric with said impeller and interposed between said impeller and said collector chamber.

2. A wet/dry vacuum appliance in accordance with claim 1, wherein said collector chamber gradually increases in height and width from a cut-off area to an outlet portion.

3. A wet/dry vacuum appliance in accordance with claim 1, wherein said power head housing defines an air intake port comprising a substantially cylindrical air path concentric with said impeller.

4. A wet/dry vacuum appliance in accordance with claim 3, further comprising an air intake shield disposed over said air intake port, said air intake shield having a plurality of air vents formed therein to permit air to be drawn into said air intake port.

5. A wet/dry vacuum appliance in accordance with claim 4, further comprising a substantially annular foam pad, disposed between said air intake shield and said air intake port and concentric with said substantially cylindrical air path.

6. A wet/dry vacuum appliance in accordance with claim 5, wherein an outer perimeter of said foam pad is secured in place by a surface of said air intake shield, such that air drawn into said air intake port first passes through said foam pad.

7. A wet/dry vacuum appliance in accordance with claim 5, further comprising a plurality of foam pad retaining tabs extending radially outward from said substantially cylindrical air path to secure an inner perimeter of said foam pad.

8. A wet/dry vacuum appliance in accordance with claim 7, further comprising a foam pad retaining member, having a substantially cylindrical body adapted to concentrically mate with said substantially cylindrical air path, said foam pad retaining tabs being carried by said foam pad retaining member.

9. A wet/dry vacuum appliance in accordance with claim 4, wherein said air intake shield defines a substantially circular air intake chamber adjacent said air intake port.

10. A wet/dry vacuum appliance in accordance with claim 1, wherein said collector scroll is disposed above said impeller, and wherein said substantially annular volume extends above said impeller.

11. A wet/dry vacuum appliance, comprising:

a collection canister;

a lid adapted to be disposed upon said collection canister;

a power head, disposed on said collection canister, said power head comprising a motor and impeller assembly rigidly disposed within a power head housing, said power head housing having an air inlet port comprising a substantially cylindrical air path concentric with said impeller;

an air intake shield having a plurality of air vents therein, said air intake shield disposed over said air inlet port and defining a smooth-walled air intake chamber adjacent said air intake port;

a substantially annular foam pad, concentric with said air inlet port and disposed between said air intake shield and said power head housing.

12. A wet/dry vacuum appliance in accordance with claim 11, further comprising a plurality of foam retaining tabs, extending radially outward from said air inlet port and adapted to secure an inner perimeter of said foam pad.

13. A wet/dry vacuum appliance in accordance with claim 12, wherein said plurality of foam pad retaining tabs are carried by a foam pad retaining member concentric with said air inlet port.

14. A wet/dry vacuum appliance in accordance with claim 12, wherein an outer perimeter of said foam pad is secured between said air intake shield and said power head housing.

* * * * *